United States Patent [19]

Schwarz, Jr.

[11] Patent Number: 4,791,959

[45] Date of Patent: Dec. 20, 1988

[54] RELEASE AGENT MANAGEMENT SYSTEM FOR A HEATED FUSER ROLL

[75] Inventor: William M. Schwarz, Jr., Webster, N.Y.

[73] Assignee: Xerox Corporation, Stamford, Conn.

[21] Appl. No.: 74,654

[22] Filed: Jul. 17, 1987

[51] Int. Cl.[4] ..... E03B 11/00

[52] U.S. Cl. ..... 137/561 A; 137/573; 137/574

[58] Field of Search ..... 137/561 A, 561 R, 571, 137/573, 574, 576, 861

[56] References Cited

U.S. PATENT DOCUMENTS

| | | | |
|---|---|---|---|
| Re. 28,968 | 9/1976 | Dove | 137/861 |
| 2,279,966 | 4/1942 | Bulkley | 137/861 X |
| 3,858,642 | 1/1975 | Battiston et al. | 137/573 X |
| 3,958,622 | 5/1976 | Sumida | 137/574 X |
| 4,000,957 | 1/1977 | Ruhland | 427/22 |
| 4,050,801 | 9/1977 | McCarroll et al. | 355/3 R |
| 4,231,653 | 11/1980 | Nagahara et al. | 355/3 FU |
| 4,536,076 | 9/1985 | Bickerstaff et al. | 355/3 FU |

FOREIGN PATENT DOCUMENTS

| | | | |
|---|---|---|---|
| 325217 | 1/1972 | U.S.S.R. | 137/561 A |

*Primary Examiner*—John Rivell

*Attorney, Agent, or Firm*—William A. Henry, II

[57] ABSTRACT

A release agent management system that assures oil delivery to a metering roll in a fuser apparatus regardless of machine tilt includes at least two race portions that direct oil to a sump depending on whether the machine is tilted more or less than an angle 0 to thereby compensate for machine tilt.

11 Claims, 1 Drawing Sheet

RELEASE AGENT MANAGEMENT SYSTEM FOR A HEATED FUSER ROLL

This invention relates to a method and apparatus for use in uniformly applying a release agent to a fuser roll in a machine regardless of machine tilt.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member of transferred from the member to a sheet of plain paper with subsequent affixing of the image thereto.

There are various ways of fusing or affixing the toner particles to the support member, one of which is by the employment of heat. In order to permanently affix or fuse electroscopic toner material onto a support material by heat, it is necessary to elevate the temperature of the toner material to a point at which the constituents of the toner material coalesce and become tacky. This action causes the toner to be absorbed to some extent into the fibers of the support member which, in many instances, constitute plain paper. Thereafter, as the toner material cools, solidification of the toner material occurs causing the toner material to be firmly bonded to the support member. In both the xerographic as well as the electrographic recording arts, the use of thermo energy for fixing toner images onto a support member is old and well known.

One approach to thermofusing of electroscopic toner images onto a support has been to pass the support with the toner images thereof between a pair of opposed roller members, at least one of which is either externally or internally heated. During operation of a fusing system of this type, the support member to which the toner images are electrostatically adhered is moved through the nip formed between the rolls with the toner images contacting the fuser roll to thereby effect heating of the toner images within the nip.

In an arrangement of the foregoing type it is customary to apply a toner release agent in liquid form to the fuser roll structure to minimize the offsetting of toner to the fuser roll structure. Prior art constructions are known which comprise a liquid absorbing material in the form of a pad which is held in contact with the fuser structure. Because the pad does not contact the supply of liquid, it is necessary to provide auxiliary devices for transporting the liquid to the pad. It will be appreciated that such devices not only increase the cost of such structures but they render them more complex and sometimes create additional problems even though they may provide the solution to other problems.

The desired contact area between the pad and fuser roll structure is predetermined and the size of the pad is fabricated in accordance therewith. When the effectiveness of the pad for applying the liquid and/or cleaning toner from the fuser roll structure diminishes, it becomes necessary to replace the pad.

A potential problem with fusers using a fluid oil for the toner release function is oil depletion at the metering roll leading to insufficient oil for stripping. Machine tilt is one cause of oil depletion since conventional systems deliver oil to one location on the wick or pad and if the machine is tilted the oil flows from there to the low end of the oil sump. Problems have been encountered with machine tilt as small as 1½ degrees.

Various oil metering systems have been tried in the past including those in U.S. Pat. Nos. 4,000,957; 4,050,801; 4,231,653; and 4,536,076. In U.S. Pat. No. 4,000,957 to Ruhland, a contact fuser assembly in a photocopies is shown. The release agent is contained in a sump, and a metering blade serves to meter the release material onto the fuser roll. The release agent application system in U.S. Pat. No. 4,050,801 to McCarroll et al. discloses silicone oil contained in a sump housing or oil pan. Oil application is achieved via a wick which is attached to a support member and is also in contact with the bottom of the sump. In reference to U.S. Pat. No. 4,231,653 to Nagahara et al., a comprehensive oil supply, application and recovery system is shown. Oil is supplied continuously by means of an oil suction pump. U.S. Pat. No. 4,536,076 to Bickerstaff et al. is directed to a distribution gallery arranged to supply a liquid to a surface. This is achieved through the use of spaced orifices which open into "dropforming" chambers. Oil is distributed to a reservoir wick from the supply gallery. The oil is them pumped under pressure to small tubular orifices which open into drop-forming chambers. From these chambers, drops of oil fall on a reservoir wick which is in contact with the surface requiring application. These patents are incorporated herein to the extent necessary to practice the present invention. Problems with insufficient oil for stripping still persist.

Accordingly, in one aspect of the present invention a release agent management system and transport apparatus assures oil delivery to the high end of a release agent sump regardless of machine tilt. The release agent transport apparatus includes two oil races that are adapted to supply release agent material to the high end of a machine at all times.

In accordance with another aspect of the present invention, a release agent transport apparatus compensates for tilt to either side of a machine through the use of two tilting cross channels running in opposite direction.

Other features of the present invention will become apparent as the following description proceeds and upon reference to the drawings in which.

Figure 1:
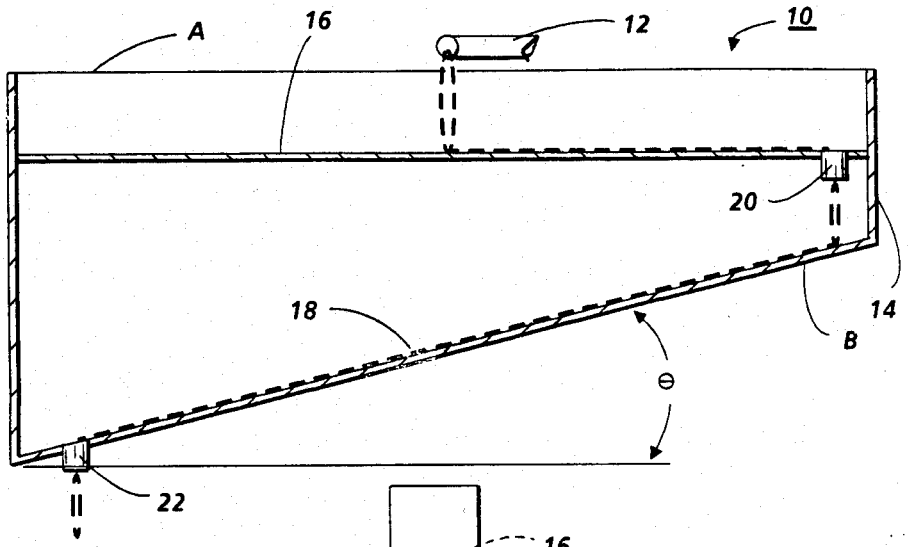
FIG. 1 is an enlarged elevational view of an apparatus employing a release agent management system in accordance with one aspect of the present invention.
Figure 2:
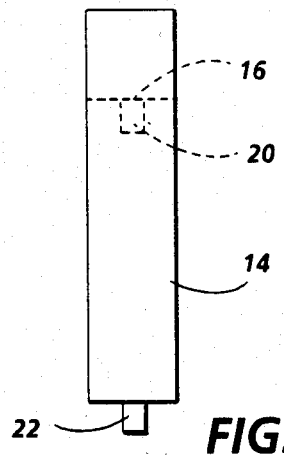
FIG. 2 is an end view of the apparatus of FIG. 1.

While the invention will be described hereinafter in connection with preferred embodiments, it will be understood that no intention is made to limit the invention to the disclosed embodiments. On the contrary, it is intended to cover all alternatives, modifications, and equivalents as may be included within the spirit and scope of the invention as defined by the appended claims.

For a general understanding of the features of the invention, reference is had to the drawings. In the drawings, like reference numerals have been used throughout to designate identical elements.

A release agent management system and oil transport apparatus is shown in FIG. 1 that solves the problem of oil depletion on the metering roll of a heated fuser roll apparatus that occurs due to the tilting of the machine in which the fuser apparatus is mounted. The oil transport apparatus 14 of FIG. 1 comprises two races 16 and 18. An inlet is shown at 12 for the input of a toner release agent such as oil into transport apparatus 14. Oil that is transported through transport apparatus 14 exits at 22 into a sump (not shown) for uniform distribution along a pad or metering roll (not shown) that cooperates with the sump to supply oil to a fuser roll (not shown) in order to prevent toner that is being fused to a copy sheet in a fuser roll nip from sticking to the fuser roll. As shown in FIG. 1, race 18 is oriented at an angle $\theta$ with respect to race 16. Race 16 is nominally horizontal in the direction perpendicular to the machine paper path. If the machine is tilted, oil entering race 16 from inlet 12 in the middle of the apparatus flows to the low side B of the transport apparatus, passes through an orifice of tube 20 onto race 18, flows down race 18 to the high side A of the transport apparatus and out of the apparatus through an orifice in tube 22 into the high end of a sump or reservoir. For example, if the tilt angle is less than the angle $\theta$, oil will flow down race 18 (i.e. towards the high side of the machine) exiting through a hole or orifice 22 on the high side of the machine (or any other place desired). Oil then enters the meter roll sump on the high side and can then flow across the sump to the low side of the machine giving in effect uniform oil delivery across the meter roll. All tilt angles can be dealt with but in practice requirements are often 3 degrees or 0.07 inches vertical rise over an approximately 14 inch span. This apparatus has advantages over prior art attempts at oil metering devices in that it is easy to fabricate from lightweight metal or plastic, offers long life since there are no moving parts, compensates automatically for a large range of tilts, is low in cost, compact and is unaffected by paper fibers, dirt, etc.

Figure 3:
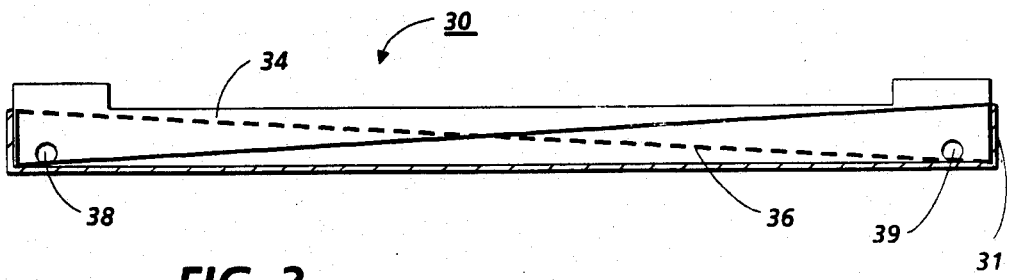
FIG. 3 is an enlarged elevational view of an alternative apparatus employing a release agent management system in accordance with another aspect of the present invention.
Figure 4:
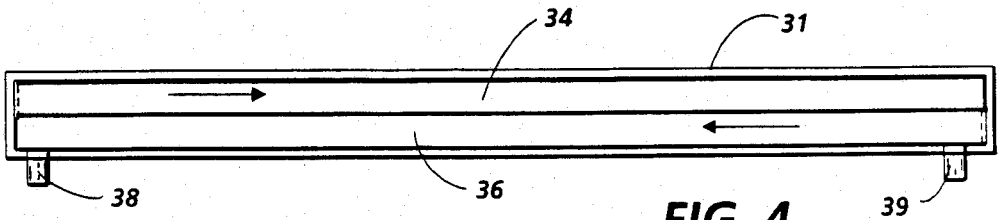
FIG. 4 is a plan view of the apparatus of FIG. 3.

A simple and inexpensive alternative embodiment of an oil transport apparatus and system that offers full compensation for machine tilt to either side is shown in FIGS. 3 and 4 as 30 and comprises a housing 31. Two cross channel or tilting races 34 and 36 are positioned within the housing 31. This configuration of the races assures oil delivery to the sump of a fuser apparatus regardless of machine tilt since the races are designed to function one at a time depending on the direction of machine tilt. Oil transport apparatus 30 solves tilt problems as minute as $1\frac{1}{2}$ degrees. In practice, upper pan and tilt channel drain holes that lead into the races can be placed where desired to achieve appropriate oil distribution, however, oil in FIGS. 3 and 4 enters in the center as shown in FIG. 1 and runs along either channel or race 34 or 36 depending on which direction the machine is tilted and would run out of either outlet 38 or 39 into the high end of the sump of a fuser apparatus.

It should now be apparent that an oil run tank and system is disclosed that compensates for the tilt of a machine that employs a heated fuse roll, a sump and metering roll or pad to apply oil to the fuser roll in order to insure release of toner from the fuser roll. The oil run tank includes at least two races that are adapted to deliver oil to the high side of the sump and thereby prevent oil depletion on the high end of the metering roll. In one instance, the oil runs comprise a substantially horizontal race and an inclined race while in a second instance the races are both tilted or crossed in opposite directions.

While the invention has been particularly shown and described with reference to preferred embodiments thereof, it will be understood by those skilled in the art that various changes in form and details may be made therein without departing from the spirit and scope of the invention.

What is claimed is:

1. A release agent transport apparatus that assures uniform distribution of release agent material onto a metering member in a heated roll fuser device regardless of machine tilt, comprising: an upstanding integral and stationary housing member having an inlet adapted to receive release agent material and an outlet for the exiting of said release agent material, at least two integral races positioned within said housing member and adapted to transport said release agent material from said inlet to said outlet, and wherein one of said at least two races is positioned substantially horizontal with respect to the direction perpendicular to the paper path of the machine and a second race in communicaton with one end of said one of said at least two races and positioned in an inclined fashion between said inlet and outlet of said housing member.

2. The apparatus of claim 1, wherein one of said at least two races is integral with the bottom of said housing member.

3. A release agent transport apparatus that assures uniform distribution of release agent material onto a metering member in a heated roll fuser device regardless of machine tilt, comprising: an upstanding housing member having an inlet adapted to receive release agent material and an outlet for the exiting of said release agent material, at least two races positioned within said housing member adapted to transport said release agent material from said inlet to said outlet, and wherein said at least two races are positioned to cross each other between said inlet and outlet such that said at least two races function one at a time depending on direction of machine tilt.

4. A release agent management system and transport apparatus that assures delivery of a release agent to the high end of the transport apparatus regardless of tilt of a machine in which the transport apparatus is mounted, comprising:

a stationary housing member included as part of said transport apparatus having an inlet and an outlet with said outlet being positioned to allow the flow of release agent material into and out of said transport apparatus, said housing member including at least two races that are adapted to transport release agent material entering said housing member through said inlet and outlet and into the high end of said transport apparatus at all times.

5. The apparatus of claim 4, wherein said at least two races includes a first race positioned substantially horizontal with respect to the direction perpendicular to a paper path of the machine and a second race in communication with said first race and positioned in an inclined fashion between said inlet and outlet of said housing member.

6. The apparatus of claim 4, wherein said at leat two races are positioned to cross each other between said inlet and outlet such that said at least two races function one at a time depending on direction of machine tilt.

7. A release agent housing apparatus adapted to transport release agent material from a source to a receiver member, comprising: an upstanding fixedly positioned housing member having an inlet adapted to receive release agent material and an outlet for the exiting of said release agent material, said housing member including at least two integral and non-rotatable races positioned within said housing member and adapted to transport the release agent material from said inlet to said outlet.

8. The apparatus of claim 7, wherein said at least two races are positioned to cross each other between said inlet and outlet such that said at least two races function one at a time depending on direction of machine tilt.

9. The apparatus of claim 7, wherein said at least two races includes a first race positioned substantially horizontal with respect to the direction perpendicular to a paper path of a machine in which said housing apparatus is mounted and a second race in communication with said first race and positioned in an inclined fashion between said inlet and outlet of said housing member.

10. The apparatus of claim 7, wherein said at least two races are in communication with each other.

11. The apparatus of claim 7, wherein one of said at least two races is integral with the bottom of said housing member.

* * * * *